US010759070B1

(12) United States Patent
Rafii

(10) Patent No.: US 10,759,070 B1
(45) Date of Patent: Sep. 1, 2020

(54) UTILITY KNIFE HAVING SAFETY GUARD AND METHOD OF USING THE SAME

(71) Applicant: Eddie Rafii, Laguna Niguel, CA (US)

(72) Inventor: Eddie Rafii, Laguna Niguel, CA (US)

( * ) Notice: Subject to any disclaimer, the term of this patent is extended or adjusted under 35 U.S.C. 154(b) by 0 days.

(21) Appl. No.: 16/351,393

(22) Filed: Mar. 12, 2019

(51) Int. Cl.
*B26B 29/02* (2006.01)
*B26B 5/00* (2006.01)

(52) U.S. Cl.
CPC ..... *B26B 29/02* (2013.01); *B26B 5/006* (2013.01)

(58) Field of Classification Search
CPC ..... B26B 29/02; B26B 5/006
USPC ..... 30/2, 286
See application file for complete search history.

(56) References Cited

U.S. PATENT DOCUMENTS 8,122,605 B2 * 2/2012 Votolato ..... B26B 5/003 30/156
8,720,068 B2 * 5/2014 Landwehr ..... B26B 29/02 30/162
8,732,956 B2 * 5/2014 McGushion ..... B26B 29/02 30/151
9,981,396 B1 * 5/2018 Rafii ..... B26B 29/02
10,300,615 B2 * 5/2019 Votolato ..... B26B 3/06
2006/0048389 A1 * 3/2006 Votolato ..... B26B 3/00 30/2
2009/0172889 A1 * 7/2009 Votolato ..... B25F 1/003 7/158
2011/0252648 A1 * 10/2011 Votolato ..... B26B 5/00 30/153
2014/0304993 A1 * 10/2014 Rafii ..... B26B 5/005 30/122

* cited by examiner

*Primary Examiner* — Hwei-Siu C Payer
(74) *Attorney, Agent, or Firm* — FisherBroyles, LLP; Rob L. Phillips

(57) ABSTRACT

A cutting device comprising: a housing containing a cutting blade with a portion of the cutting blade extending from the housing; a safety guard having an end positioned proximate to the cutting blade portion extending from the housing; and a spring-biased safety guard release connected to an elongated member, the elongated member in communication with an arcuate, flat spring extending from a second end of the safety guard. In this manner, as soon as pressure is released from the cutting blade, the safety guard returns to its home position even if the safety guard release button is still being pressed. Thus, the cutting blade is only fully exposed without the safety guard in place when the cutting blade is being used to cut an article.

14 Claims, 7 Drawing Sheets

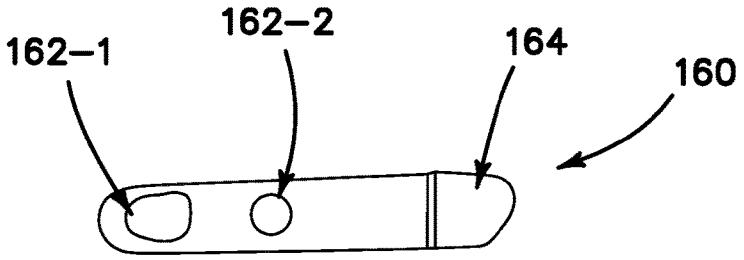
FIG. 6A
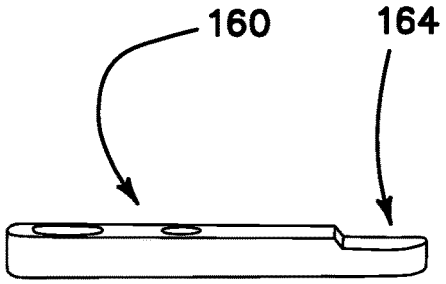
FIG. 6B
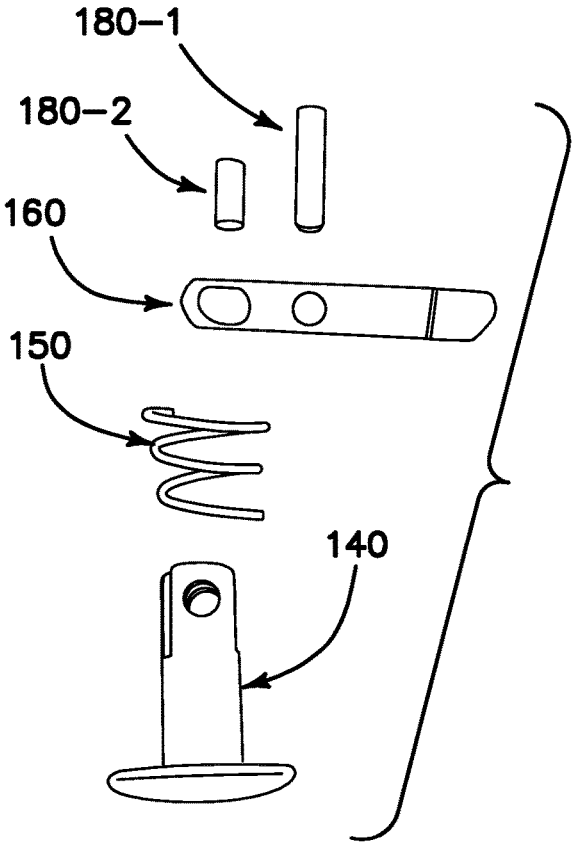
FIG. 7A
FIG. 7B
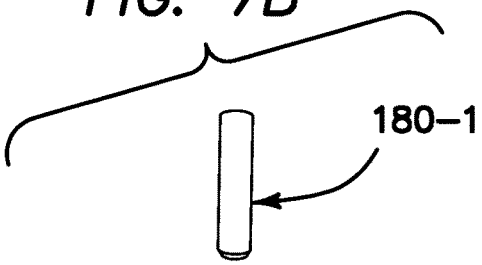
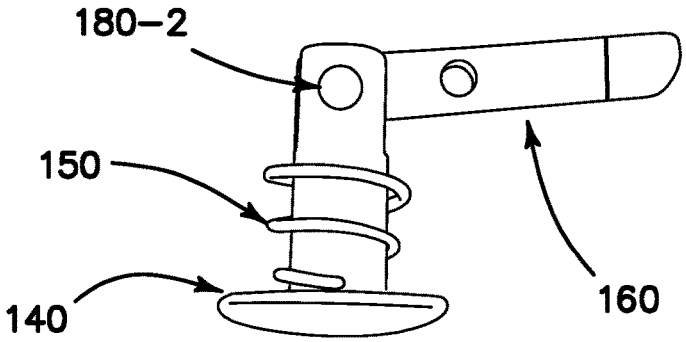

UTILITY KNIFE HAVING SAFETY GUARD AND METHOD OF USING THE SAME

FIELD OF THE INVENTION

The embodiments of the present invention relate to a utility knife having a safety guard to prevent accidental injuries.

BACKGROUND

Utility knives use razor blades to cut open boxes or cut other articles. The primary drawback with utility knives is the inevitable cutting of one's own hand, wrist or arm while using the utility knife to cut an article.

It would be advantageous to develop a utility knife with a safety guard which retracts when using the utility knife and automatically deploys once a cutting action is stopped.

SUMMARY

Accordingly, one embodiment of the present invention is a cutting device comprising: a housing containing a cutting blade with a portion of said cutting blade extending from said housing; a safety guard having an end positioned proximate to said cutting blade portion extending from said housing; and a spring-biased safety guard release connected to an elongated member, said elongated member in communication with an arcuate, flat spring extending from a second end of said safety guard, said spring-biased safety guard release mechanism configured to allow said one end of said safety guard to move into said housing responsive to pressure thereon.

In use, when depressed, the safety guard release unlocks the safety guard causing the safety guard, when pressed, along with the cutting blade portion extending from the housing, against an article to be cut, to retract into the housing leaving the cutting blade unguarded. In one embodiment, the safety guard release mechanism is a single operation device meaning that each time the user removes pressure from the cutting blade extending from the housing, the user will need to once again activate the safety guard release mechanism to cause the safety guard to unlock. The single operation design creates an additional layer of safety.

Other variations, embodiments and features of the present invention will become evident from the following detailed description, drawings and claims.

BRIEF DESCRIPTION OF THE DRAWINGS

FIGS. 6A and 6B illustrates a safety guard release elongated member according to the embodiments of the present invention;

FIGS. 7A and 7B illustrate a safety guard release mechanism according to the embodiments of the present invention;

DETAILED DESCRIPTION

Figure 1:
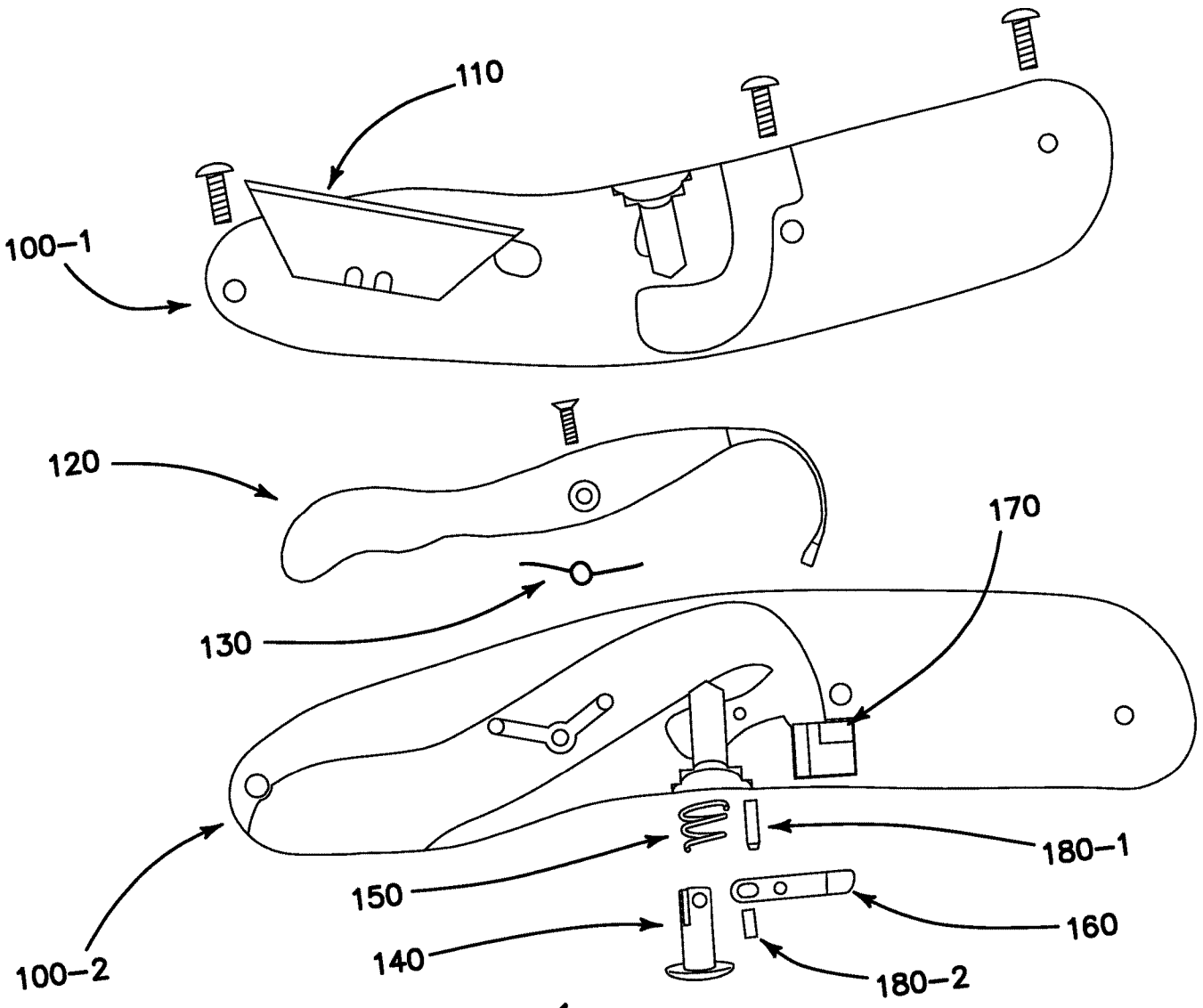
FIG. 1 illustrates an inner view of a utility knife housing opened along a longitudinal center-line according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The individual parts of the utility knife may be fabricated of metals, plastics, composites, alloys, polymers and combinations thereof. The individual parts of the utility knife may be fabricated using suitable techniques including molding, machining, rapid prototyping, casting and combinations thereof.

Figure 2:
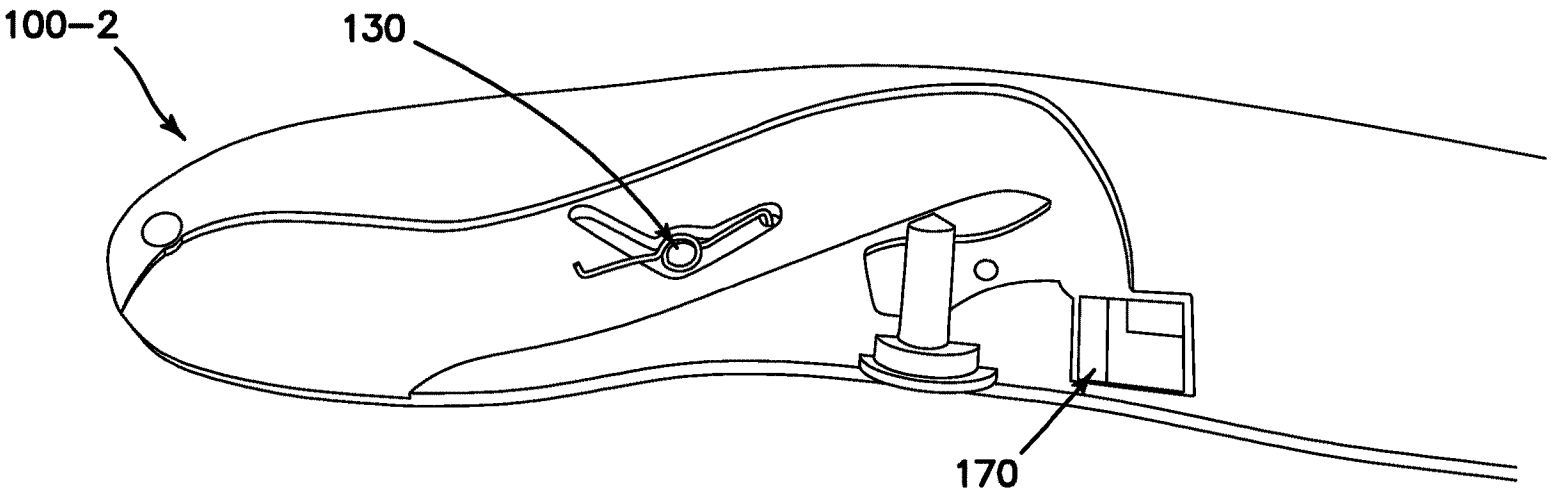
FIG. 2 illustrates an inner view of one side of the housing of the utility knife with some components removed according to the embodiments of the present invention.

In broadest terms, the utility knife described herein includes a housing, cutting blade, safety guard having an arcuate, flat spring extending from one end and a safety guard release mechanism. FIG. 1 shows a utility knife housing 100 cut along its length into two pieces 100-1, 100-2 to reveal the inner components thereof (some in position and others removed to allow all components to be observed). As shown, the utility knife housing 100 is configured to at least partially contain a cutting blade 110, safety guard 120, safety guard spring 130, safety guard release button 140, safety guard release spring 150, safety guard elongated member 160, safety guard release plate 170 and safety guard release pins 180-1, 180-2. FIG. 2 shows housing piece 100-2 with safety guard spring 130 and safety guard release plate 170 in position.

Figure 3:
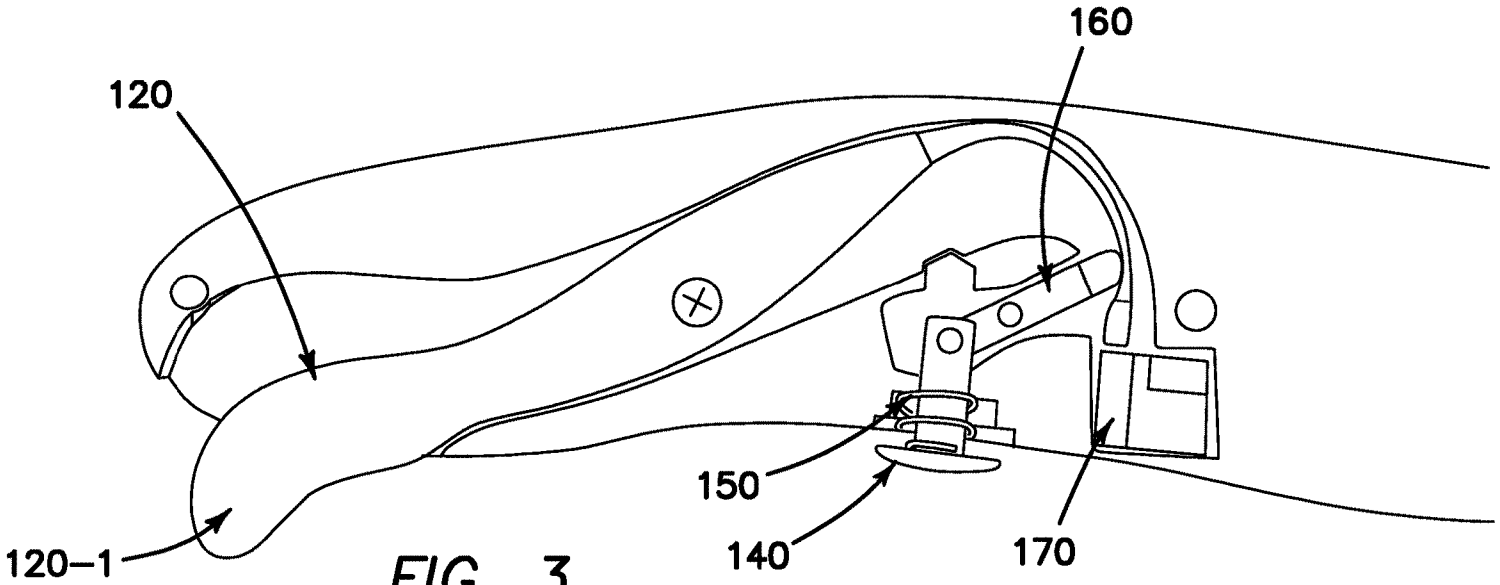
FIG. 3 illustrates an inner view of one side of the housing of the utility knife with all components in position according to the embodiments of the present invention.
Figure 4:
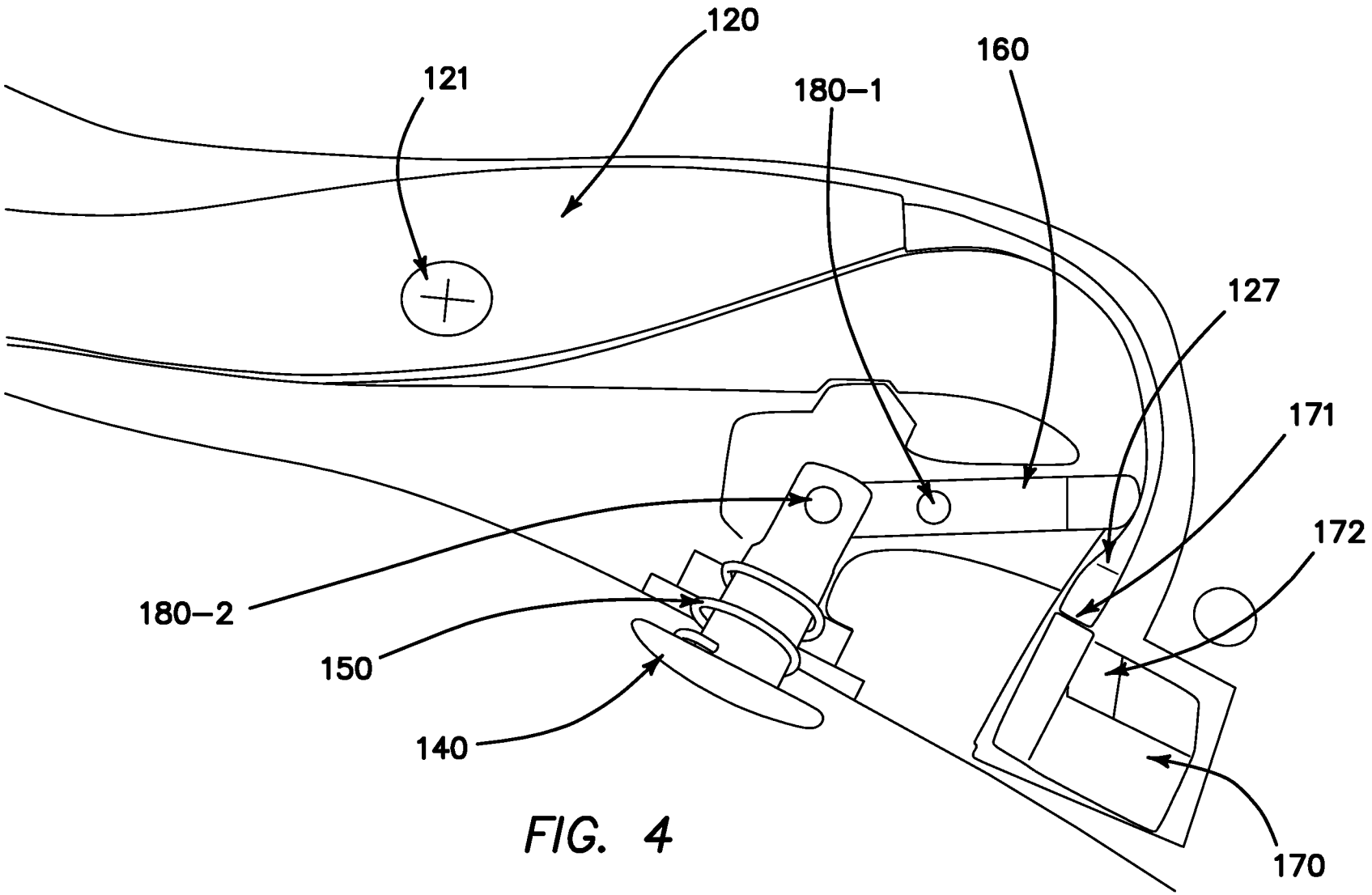
FIG. 4 illustrates a close-up inner view of one side of the housing of the utility knife showing a safety guard release according to the embodiments of the present invention.

FIGS. 3 and 4 show housing piece 100-2 with the safety guard 120, safety guard spring 130, safety guard release button 140, safety guard release spring 150, safety guard elongated member 160, plate 170 and safety guard release pins 180-1, 180-2 in position.

Figure 5A:
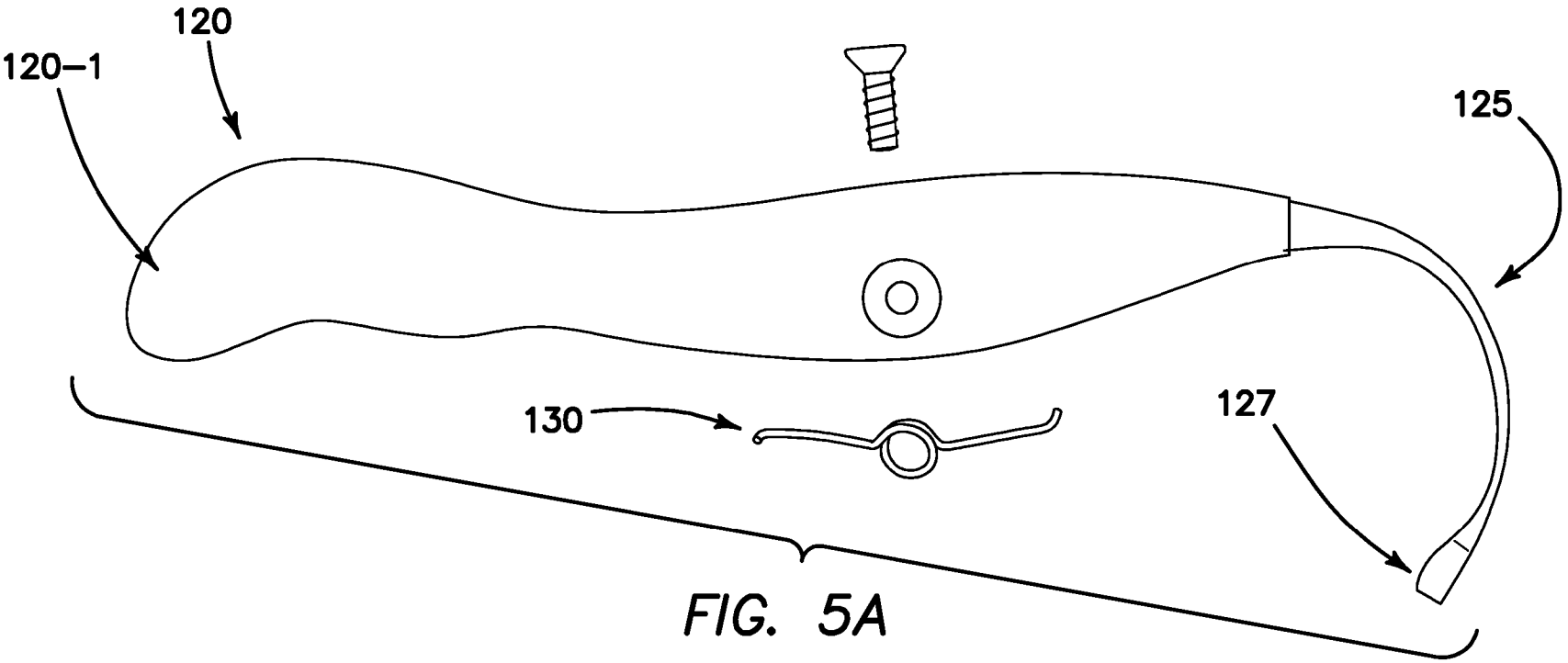
FIGS. 5A and 5B illustrate a safety guard according to the embodiments of the present invention.
Figure 5B:
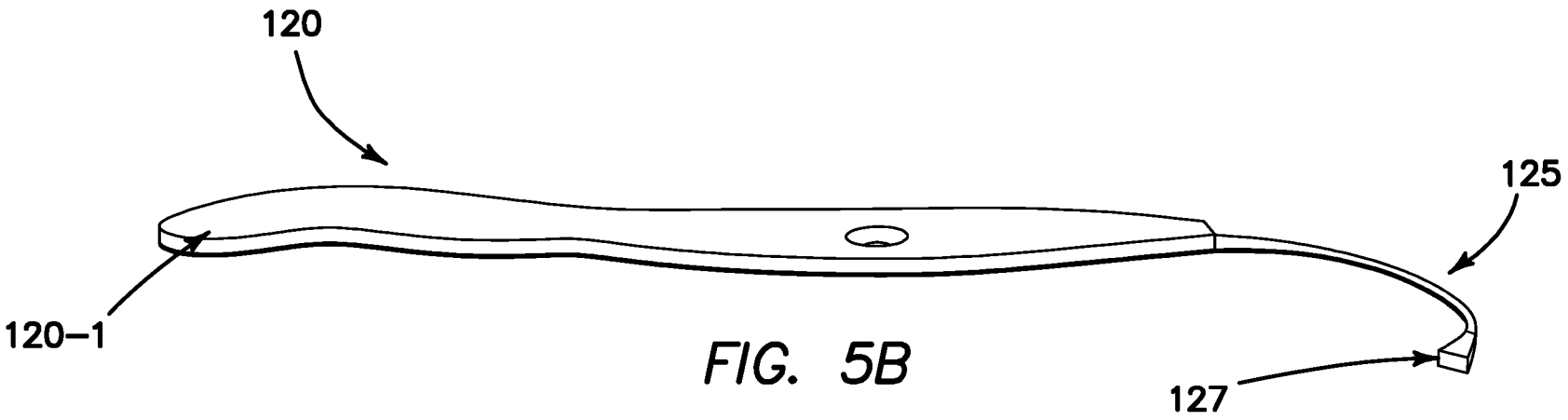

FIGS. 5A and 5B show the safety guard 120 according to the embodiments of the present invention. The safety guard 120 comprises a cutting blade guard at one end 120-1 and an arcuate, flat spring 125 extending from a second end thereof. One end 127 of the arcuate, flat spring 125 is wider and flatter than the main body of the arcuate, flat spring 125 for reasons set forth below.

FIGS. 6A and 6B show the safety guard release elongated member 160 according to the embodiments of the present invention. The safety guard release elongated member 160 includes two pin openings 162-1 and 162-2 and a stepped down end 164 having a reduced thickness for reasons set forth below.

FIGS. 7A and 7B illustrate a safety guard release mechanism according to the embodiments of the present invention. The safety guard release mechanism includes a safety guard release button 140, safety guard release spring 150, safety guard elongated member 160 and safety guard release pins

180-1, 180-2 which operate collectively to unlock the safety guard 120 during a cutting action.

To prevent a user from being cut by the cutting blade 110, a portion of the safety guard 120 extends from the housing 100 parallel to the cutting blade 110. In this manner, the safety guard 120 prevents a user from inadvertently contacting the cutting blade 110. The safety guard 110 is in a default locked or home position unless the safety guard release mechanism is activated using the safety guard release button 140 and pressure is applied to the safety guard 120 via a cutting action. Pressing the safety guard release button 140 unlocks the safety guard 120 such that applying pressure to the one end 120-1 of the safety guard 120 allows the exposed portion of the safety guard 120 to move into the housing 100 allowing the portion of the cutting blade 110 extending from the housing 100 to cut an article.

Figure 8A:
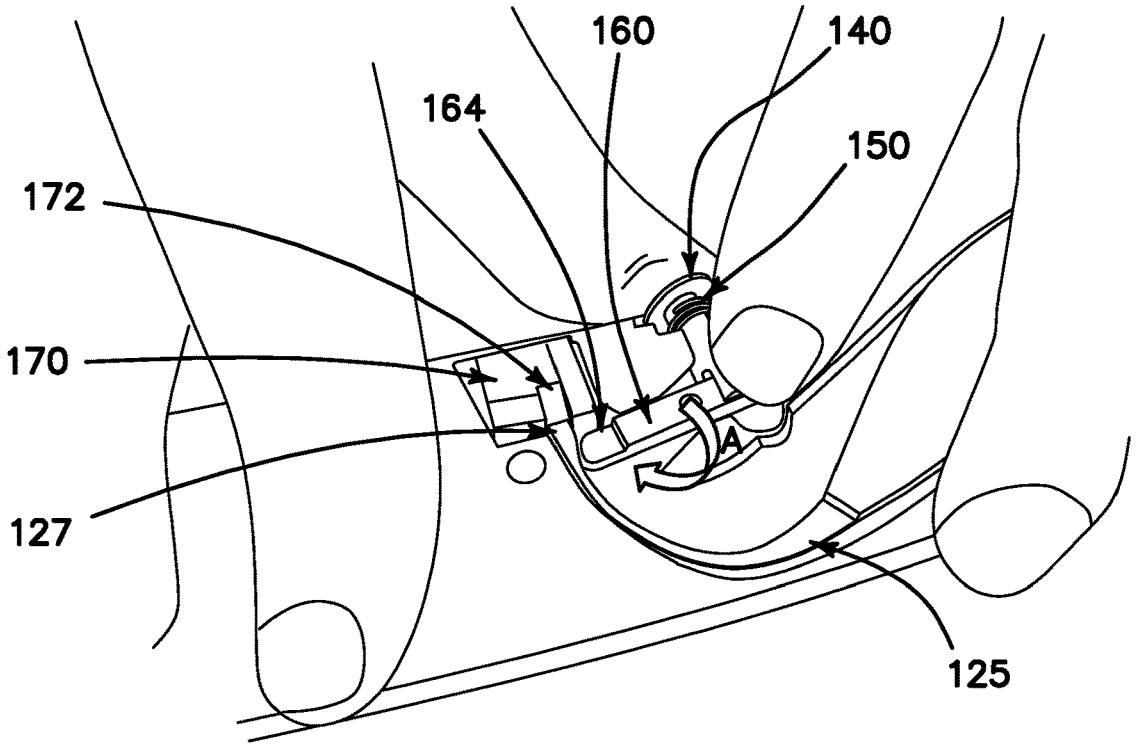
FIGS. 8A through 8C illustrate operation of the utility knife according to the embodiments of the present invention.
Figure 8B:
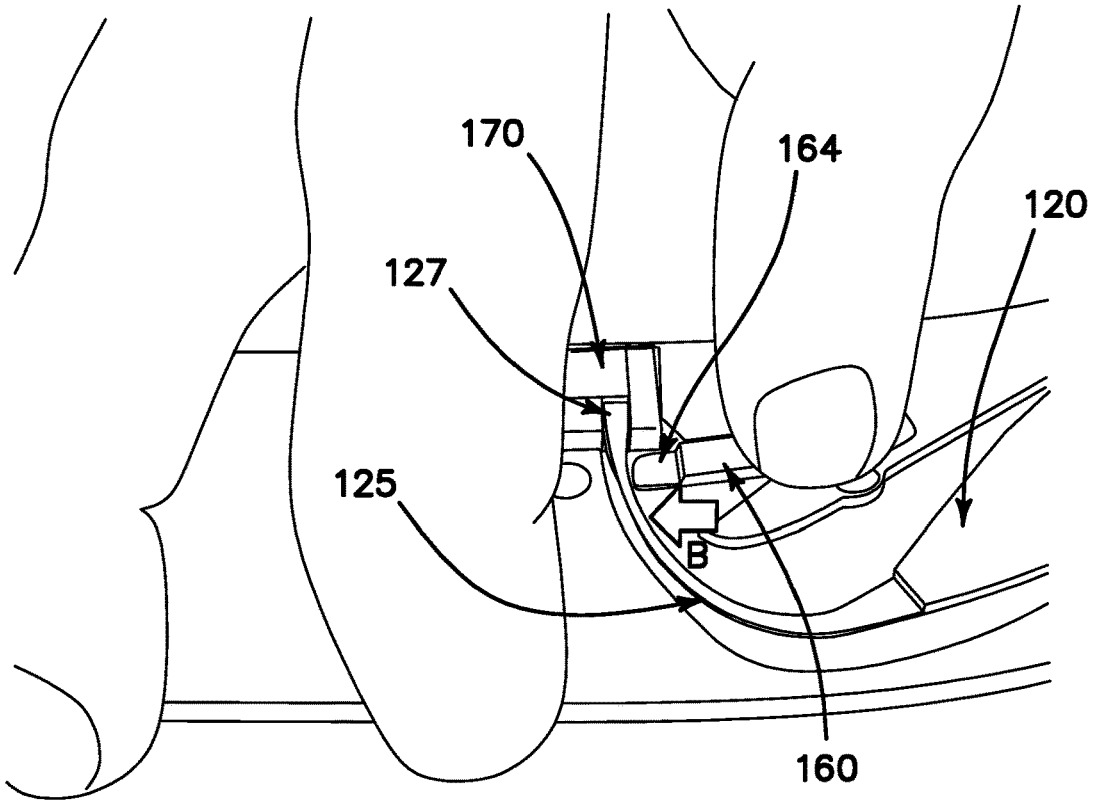
Figure 8C:
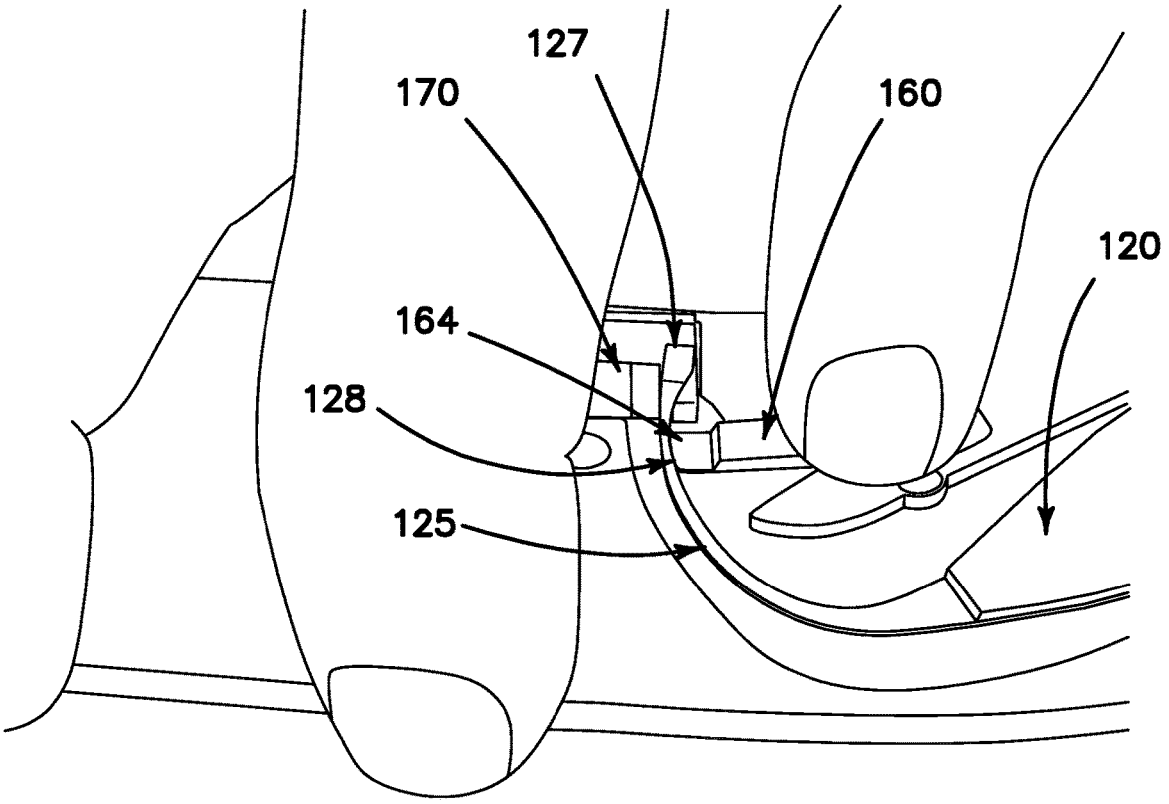
Figure 9:
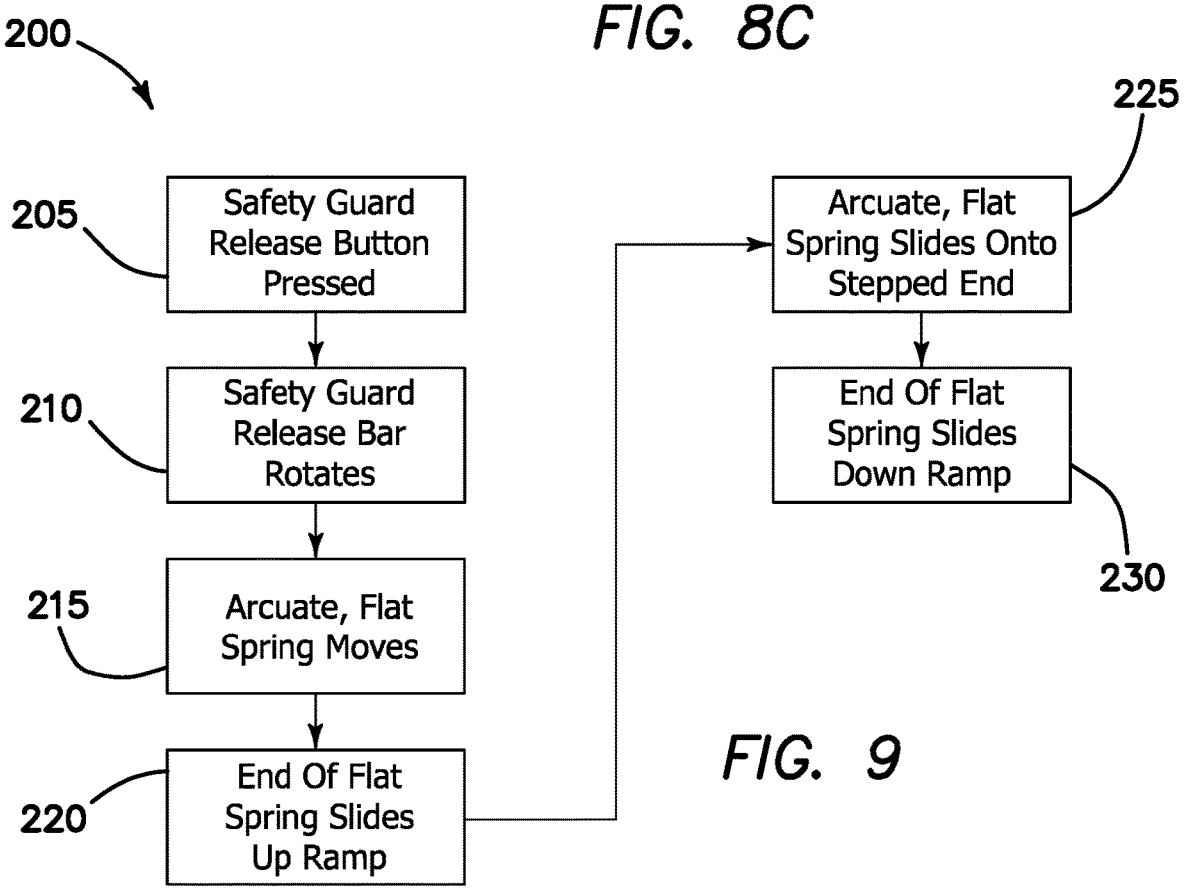
FIG. 9 illustrates a flow chart detailing operation of the utility knife according to the embodiments of the present invention.

FIGS. 8A through 8C show operation of the utility knife in conjunction with flow chart 200 detailing operation of the utility knife according to the embodiments of the present invention. As shown in FIG. 8A, once a user presses the safety guard release button 140, the rotatably connected safety guard elongated member 160 rotates slightly in direction of arrow A about pin 180-1 from its home position. FIGS. 3 and 4 show the home position of the safety guard elongated member 160. As the safety guard elongated member 160 rotates, the safety guard elongated member 160 forces the arcuate, flat spring 125 to move in a direction of arrow B away from its home position as shown in FIGS. 3 and 4. The home position of the arcuate, flat spring 125 is maintained by wall 171 of plate 170 upon which end 127 of arcuate, flat spring 125 rests. As the arcuate, flat spring 125 moves away from its home position against the wall 170, end 127 encounters and slides up ramp 172 of plate 170 permitting the safety guard 120 to rotate about point 121 (spring 130) such that end 120-1 of the safety guard 120 moves into the housing 100. Once the end 127 slides up the ramp, a portion 128 of the arcuate, flat spring 125 elevates such that it may move onto stepped down end 164 of safety guard elongated member 160. End 127 of safety guard 120 now rests on top of the ramp 172 proximate the wall 171. In this manner, as soon as pressure is released from the cutting blade 110, the safety guard 120 returns to its home position even if the safety guard release button 140 is still being pressed. Returning to the home position occurs since stepped down end 164 permits the arcuate, flat spring 125 to slide down the ramp 172 until end 127 once again rests against wall 171 of plate 170. Spring 130 acts to return the safety guard 120 to its home position once pressure is removed from the cutting device 110. Once safety guard release button 140 is no longer pressed, spring 150 pushes the safety guard release button 140 to its home position which causes the safety guard elongated member 160 to also move to its home position.

Flow chart 200 details the operation of the utility knife 100. At 205, the user presses the safety guard release button 140. At 210, the safety guard elongated member 160 rotates caused by the connected safety guard release button 140. At 215, the rotating safety guard elongated member 140 forces the arcuate, flat spring 125 to move. At 220, end 127 of the arcuate, flat spring 125 slides up ramp 172 of plate 170. At 225, once end 127 is completely up the ramp, a portion of the arcuate, flat spring 125 moves onto stepped down end 164 of safety guard elongated member 160. At 230, once pressure is released from the cutting blade 110, the arcuate, flat spring 125 slides down the ramp 172 until end 127 once again rests against wall 171 of plate 170. Once a user stops pressing the safety guard release button 140, spring 150 returns the safety guard release button 140 and the utility knife 100 to its home position.

Although the invention has been described in detail with reference to several embodiments, additional variations and modifications exist within the scope and spirit of the invention as described and defined in the following claims.

I claim:

1. A cutting device comprising:

a housing containing a cutting blade with a portion of said cutting blade extending from said housing;

a safety guard having one end positioned proximate to said portion extending from said housing;

a spring-biased safety guard release mechanism connected to a rotatable member, said member in communication with an arcuate, flat spring extending from a second end of said safety guard, said spring-biased safety guard release mechanism configured to allow said one end of said safety guard to move into said housing responsive to pressure thereto; and a plate within said housing, said plate having at least a wall and a ramp.

2. The cutting device of claim 1 wherein one end of said arcuate, flat spring rests against said wall when said cutting device is in a home position.

3. The cutting device of claim 2 wherein said one end of said arcuate, flat spring is configured to slide up said ramp responsive to said spring-biased safety guard release mechanism being activated.

4. The cutting device of claim 2 wherein said one end of said arcuate, flat spring is flatter and wider than other portions of said arcuate, flat spring.

5. The cutting device of claim 1 wherein said spring-biased safety guard release mechanism includes a spring-biased safety guard release button.

6. The cutting device of claim 1 further comprising a spring connected to said safety guard and configured to return said safety guard to a home position after pressure is removed from said cutting device.

7. The cutting device of claim 1 wherein said member is elongated and has a stepped down end, said stepped down end in communication with said arcuate, flat spring.

8. A cutting device comprising:

a housing containing a cutting blade with a portion of said cutting blade extending from said housing;

a safety guard configured to prevent said cutting blade from contacting an article, said safety guard having a first end positioned proximate to the cutting blade and a second end having an arcuate, flat spring extending therefrom;

a safety guard release mechanism configured, responsive to a user's input, to move said arcuate, flat spring allowing said first end of said safety guard to move into said housing and expose the cutting blade for a cutting action; and a plate having a wall and a ramp, said wall configured to retain said safety guard in a home position and said ramp configured to allow said safety guard to move from said home position to a cutting position responsive to activation of said safety guard release mechanism.

9. The cutting device of claim 8 wherein said safety guard release mechanism comprises a spring-biased release button connected to an elongated member, said elongated member positioned to interact with said arcuate, flat spring.

10. The cutting device of claim 9 wherein said elongated member includes a stepped down end positioned to permit a portion of said arcuate, flat spring to slide onto said stepped down end of said elongated member.

11. The cutting device of claim 8 wherein one end of said arcuate, flat spring is flatter and wider than other portions of said arcuate, flat spring.

12. A cutting device comprising:

a housing containing a cutting blade with a portion of said cutting blade extending from said housing;

a safety guard having one end positioned proximate to said cutting blade portion extending from said housing, said safety guard movable about a spring and having an arcuate, flat spring extending from a second end thereof;

a safety guard release mechanism comprising a spring-biased release button connected to an elongated member, said elongated member having a stepped down end positioned to interact with said arcuate, flat spring; and a plate within said housing, said plate including a wall and a ramp, said wall configured to maintain said safety guard in a home position, said ramp positioned to allow one end of said arcuate, flat spring to slide up responsive to said elongated member moving said arcuate, flat spring.

13. The cutting device of claim 12 wherein said stepped down end of said elongated member is positioned to permit a portion of said arcuate, flat spring to slide onto said stepped down end of said elongated member.

14. The cutting device of claim 12 wherein said one end of said arcuate, flat spring is flatter and wider than other portions of said arcuate, flat spring.

* * * * *